US005873009A

United States Patent [19]

Yamashita et al.

[11] Patent Number: 5,873,009

[45] Date of Patent: Feb. 16, 1999

[54] EQUIPMENT MANAGEMENT SYSTEM THAT ISSUES A WARNING WHEN THE LIFETIME OF A COMPONENT HAS BEEN EXCEEDED AND DISABLES THE WARNING WHEN SUCH A WARNING IS TO BE GENERATED FOR A DIFFERENT COMPONENT

[75] Inventors: Yuji Yamashita; Jiro Nagira; Yasuhiro Hashimoto; Hiroshige Utatsu, all of Osaka, Japan

[73] Assignee: Mita Industrial Co., Ltd., Osaka, Japan

[21] Appl. No.: 739,043

[22] Filed: Oct. 28, 1996

[30] Foreign Application Priority Data

Nov. 6, 1995 [JP] Japan ..... 7-287132

[51] Int. Cl.[6] ..... G03G 21/00

[52] U.S. Cl. ..... 399/8; 364/184; 399/10; 399/24; 399/79

[58] Field of Search ..... 399/1, 8, 31, 10, 399/79, 24; 395/182.21

[56] References Cited

U.S. PATENT DOCUMENTS 5,066,978 11/1991 Watarai et al. ..... 399/24
5,077,582 12/1991 Kravette et al. ..... 399/8
5,414,494 5/1995 Aikens et al. ..... 399/1
5,596,390 1/1997 Sawada ..... 399/8
5,610,725 3/1997 Kawada et al. ..... 358/403
5,786,994 7/1998 Friz et al. ..... 364/184

*Primary Examiner*—Arthur T. Grimley
*Assistant Examiner*—Quana Grainger
*Attorney, Agent, or Firm*—Beveridge, DeGrandi, Weilacher & Young, LLP

[57] ABSTRACT

In a system in which a host computer performs lifetime management for components of a plurality of copiers, components whose lifetimes are to be managed can be freely selected copier by copier and, as a result, warning reports can be transmitted with a reduced number of communication sessions. The copiers are each equipped with a device for management, so that counting can be performed for their individual components and interlock counts for such counting can be freely specified. The host computer compares a count received through communication with a threshold value to issue a report within the host computer. Within one copier, during a period after a component PM call is issued and before a component is replaced, even if another component becomes a target of a component PM call, the component PM call is not issued. When a component replacement report is received, a report of a component PM call is automatically deleted from an urgency report list. A component whose component PM call has been exceeded is indicated with a mark requesting replacement.

15 Claims, 10 Drawing Sheets

FIG. 5

30a

30

| | Communications Control Device | |
|---|---|---|
| | Interlocked Count | Count |
| 1 | Top-Deck Paper-Feed Count | 110,000 |
| 2 | . . . | . . . |
| 3 | . . . | . . . |
| 4 | . . . | . . . |
| 5 | . . . | . . . |
| ⋮ | ⋮ | ⋮ |
| 30 | . . . | . . . |

FIG. 8

40

Maintenance Item | Replacement Component | HELP F1

| RE | MP | Component No. | Component Name | Work Type | % | Remain |
|---|---|---|---|---|---|---|
| | --- | -------- | -------- Setup -------- | -------- | --- | -------- |
| | | 0000000 | Developer | Replacement | 80 | 40000 |
| | | 0000000 | Toner | Replacement | 80 | 40000 |
| | --- | -------- | -------- Drum Unit -------- | -------- | --- | -------- |
| | | 4292953 | Tungsten Wire (50M) (X3) | Replacement | 80 | 40000 |
| | --- | -------- | -------- Cleaning -------- | -------- | --- | -------- |
| | 11 | 6671804 | Blade, Cleaning Unit | Replacement | 20 | 160000 |
| | | 0000000 | Cleaning Brush Member | Replacement | 80 | 40000 |
| RE | --- | -------- | ------ Developer Section ----- | -------- | --- | -------- |
| | | 6151404 | Lever, Lower Developing Roller | Replacement | 120 | -40000 |
| | --- | -------- | ------ Fixation Section ----- | -------- | --- | -------- |
| | 15 | 7862024 | Oil Roller | Replacement | 80 | 40000 |
| | 16 | 7862025 | Cleaning Roller (Heat Roller) | Replacement | 80 | 40000 |
| | --- | -------- | ------ Table (RADF) ----- | -------- | --- | -------- |
| | | 7870622 | Front Pin Tractor | Replacement | 60 | 60000 |

Previous Page | Next Page | Page:1/2

EQUIPMENT MANAGEMENT SYSTEM THAT ISSUES A WARNING WHEN THE LIFETIME OF A COMPONENT HAS BEEN EXCEEDED AND DISABLES THE WARNING WHEN SUCH A WARNING IS TO BE GENERATED FOR A DIFFERENT COMPONENT

BACKGROUND OF THE INVENTION

1. Field of the Invention

The present invention relates to an equipment management system for systematically performing data communication and managing a network, such as a management system for supporting component-by-component maintenance services for components that require regular replacement such as photosensitive drums and paper feeding parts of electronic photocopiers, and especially relates to an improvement on the method of managing component lifetimes.

2. Description of the Prior Art

These days, between users of photocopiers and a maintenance company that manages those copiers is often operated a copier management system that mainly utilizes telephone lines. Such a management system enables the maintenance company to collectively manage a large number of copiers in terms of, for example, replacement component procurement, machine condition, copy count, paper-jam history, maintenance data, and others, on a copier-by-copier basis.

Generally, in a copier management system of this type, a communications control device is attached to each of the copiers, and a host computer is installed in the maintenance company. The device is linked to the host computer over a telephone line via communications modems provided at each end. Here, the host computer not only receives from the device all data concerning the copier, including data for calling a serviceperson, but it also sets data on that device; for example, the host computer sets the phone number by which it is accessed, the time at which regular periodical dialing is performed, the copy count permitted under contract, and others, in order to initialize the copier. Based on those settings, the device communicates with the host computer. In this way, all the copiers are managed collectively.

In such a management system, the communications control device is conventionally constructed, for example, as follows. The conventional device is provided with a plurality, e.g. 22, of resettable count fields, and those count fields are each allocated to different major components or units that require replacement as a result of exhaustion or wear. Some of these components or units are interlocked with the total count of the copier, and some are interlocked with other signals. For example, in the case of paper-feed units, each paper-feed unit individually performs paper-feed actions, and the total count is incremented every time such a paper-feed action takes place.

It is possible to set threshold values individually for the counts stored in the above described component-by-component count fields provided in the device, so that, when a threshold value is exceeded, the device generates a report indicating that the corresponding component is being used beyond its lifetime, and transmits the report to the host computer. The host computer regularly checks such reports received from the device, so that, if necessary, a serviceperson visits the site where the copier is installed and performs maintenance work for the copier, including replacement of components listed in such reports.

The threshold values are usually set to, for example, 90% of actual component lifetimes, so that the components can be monitored to be protected against use beyond their lifetimes. Furthermore, when a threshold value for a component is exceeded, it is also possible, in addition to transmitting a warning report to the host computer, to transmit all the component-by-component count data at the same time as such a report is transmitted. Note that the counts in the count fields can be reset individually on an occasion of maintenance of the copier.

However, in the above described conventional system, the 22 count fields are individually compared with their respective threshold values, and, every time one threshold value is exceeded, the host computer needs to be accessed through communication. This means that communication occurs 22 times at most. As a result, such a system not only leads to high communication costs, but also makes monitoring tasks difficult because, during periods between regular checking sessions, the host computer becomes heavily loaded with reports from the device, with its screen filled with a large amount of information.

To solve such problems related to communication costs and others, the device may be so configured that, when a threshold value for one component is exceeded, the device transmits the count data for the other components as well. This allows the counts to be reset every time communication takes place, and accordingly only one communication session is required. However, since the counts for components other than that particular component are also reset, it is not possible to know the conditions after the communication session. Thus, this configuration fails to achieve the original aim.

Moreover, even though these 22 count fields are incremented according to signals from the copier that are interlocked with them, the counts for individual components and the signals from the copier that are available in the conventional system are predetermined. Accordingly, each count field corresponds to a particular component, and is distinguished by a generic name such as "photosensitive drum" and "developer". For example, for a five-deck paper feed section, even though the first to fifth paper feed decks are defined separately, counting cannot be performed on a component-by-component basis within the paper feed section.

As described above, since the count fields are fixed fields that correspond one-to-one to particular components, it is impossible to flexibly cope with cases where, for example, the copier is replaced with a new model which has a different construction. Specifically, in the above described example, it is impossible to separately manage the individual components within the same paper feed section. More specifically, the paper feed section has a different number of decks depending on the model, and therefore, if the paper feed section has less than five decks, one or more fields will be left unused and blank. Moreover, it is impossible to cope with a model that includes a new expendable component to which no count field is allocated.

SUMMARY OF THE INVENTION

An object of the present invention is to provide an equipment management system having the following capabilities: count fields provided in a communications control device can be freely allocated to individual components; names of components unique to a particular copier can be registered; interlock counts can be freely specified; components whose lifetime is to be managed can be freely selected on a copier-by-copier basis; warning reports can be transmitted with a reduced number of communication sessions; and every single component can be managed in term of its lifetime.

To achieve the above object, according to the present invention, in an equipment management system comprising a communications control device that is attached to a managed piece of equipment so as to transmit equipment management data with which the piece of equipment is managed, and a host computer that is connected to the communications control device through a communications network so as to collectively manage data received from the communications control device, the communications control device is provided with a component lifetime management means, and the host computer is provided with a warning means and a warning disabling means.

The component lifetime management means provided in the communications control device has a plurality of count fields, which can be freely allocated to a plurality of individual components of the managed piece of equipment and which can be reset in response to a signal received from the managed piece of equipment, and is capable of freely specifying interlock counts for individual count fields. Accordingly, it is possible to perform lifetime management on a component-by-component basis, and thus to perform maintenance work without fail.

The warning means provided in the host computer compares, for every component, a count value received from the communications control device and stored in the component lifetime management means with a threshold value and, when there exists a component whose threshold value is exceeded, recognizes necessity of component replacement and issues a component replacement warning. Accordingly, as against the conventional system where threshold values are stored in the device, it is possible to dispense with an extra amount of communication, and thus to reduce communication costs.

The warning disabling means disables issuance of a component replacement warning if, during a period after issuance of a component replacement warning for one component and before replacement of the component targeted by the warning, another component becomes a target of a component replacement warning. Accordingly, since only one report is displayed until a component is replaced, it is possible to make the listing easy to follow, and thus to alleviate the workload for processing reports. Moreover, since the number of reports is minimized, it is possible to make the listing easy to grasp, and thus to improve work efficiency.

In the above described construction, the communications control device may be provided with a capability of issuing a component replacement report when a component requiring replacement is replaced. Moreover, the warning means of the host computer may be provided with a capability of issuing a component urgency report list for displaying a listing of components targeted by component replacement warnings. In this case, when a component replacement report is received from the communications control device, a process for indicating that the corresponding component has already been replaced is automatically performed from within the component urgency report list.

In this construction, when a component is replaced, the corresponding entry in the urgency report list can be deleted automatically. Accordingly, it is possible to prevent the same maintenance work from being performed doubly because of the failure of the host computer to perform due processing. Moreover, even under the condition that one component has already been replaced and the entry corresponding to that component has been automatically deleted from the urgency report list, if a threshold value for some other component is exceeded and that component has not been replaced, a new warning can be issued. Accordingly, it is possible to replace components without fail.

The host computer may be provided with a capability of adding a mark requesting replacement to those entries listed on a management list which correspond to components targeted by component replacement warnings. In this case, since entries representing components that are being used beyond their lifetimes are displayed with a mark in the list, it is possible to procure components beforehand without fail.

Furthermore, the host computer may be provided with a capability of continuing its usual processing based on expected lifetimes of components when count values for individual components stored in the component lifetime management means cannot be received through communication with the communications control device. In this case, a warning is issued based on an expected value when there is no communication. Accordingly, it is possible to operate the system without any inconvenience even in the cases where communication intervals are long.

The equipment management system of the present invention is suitable for a management system where a communications control device is attached to each copier so as to transmit data concerning the use of the copier.

BRIEF DESCRIPTION OF THE DRAWINGS

This and other objects and features of this invention will become clear from the following description, taken in conjunction with the preferred embodiments with reference to the accompanied drawings in which:

FIG. 5 is a diagram showing the count fields in the device;

FIG. 8 is a diagram showing the screen for displaying the details of maintenance data;

DESCRIPTION OF THE PREFERRED EMBODIMENTS

Figure 1:
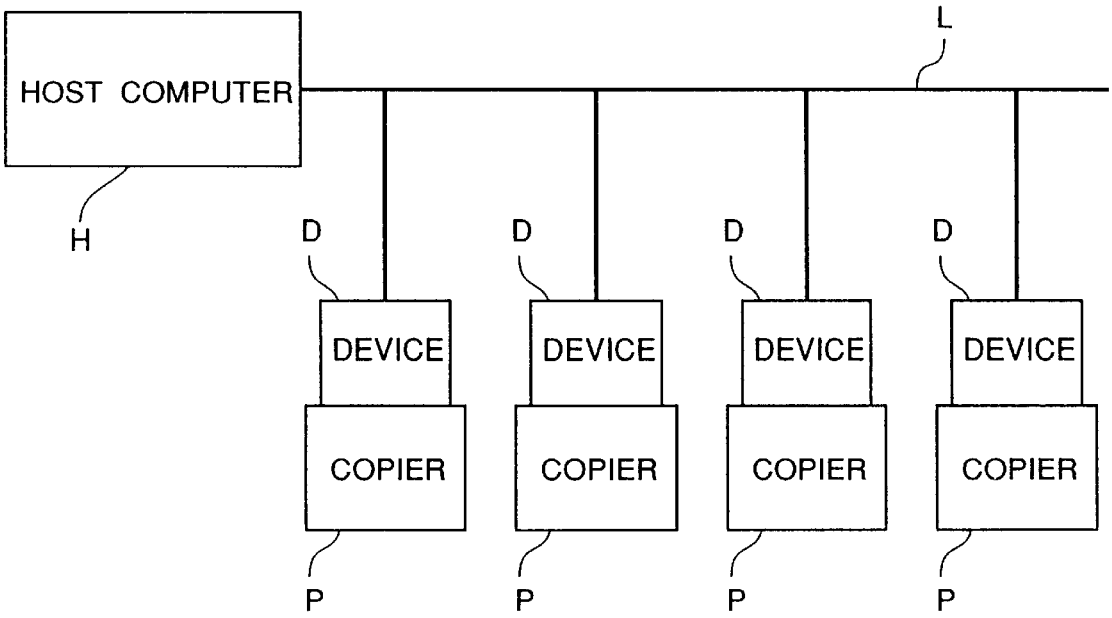
FIG. 1 is a block diagram showing the outline of a management system embodying the present invention.

Hereinafter, an embodiment in which the present invention is applied to a management system for copiers will be described with reference to the drawings. FIG. 1 schematically shows an example of the copier management system. As shown in FIG. 1, this copier management system comprises a host computer H for managing maintenance work, installed at a maintenance company, and a plurality of copiers P as pieces of equipment to be managed. Each copier P is equipped with a communications control device D, which is linked to the host computer H through a public telephone line L.

Figure 2:
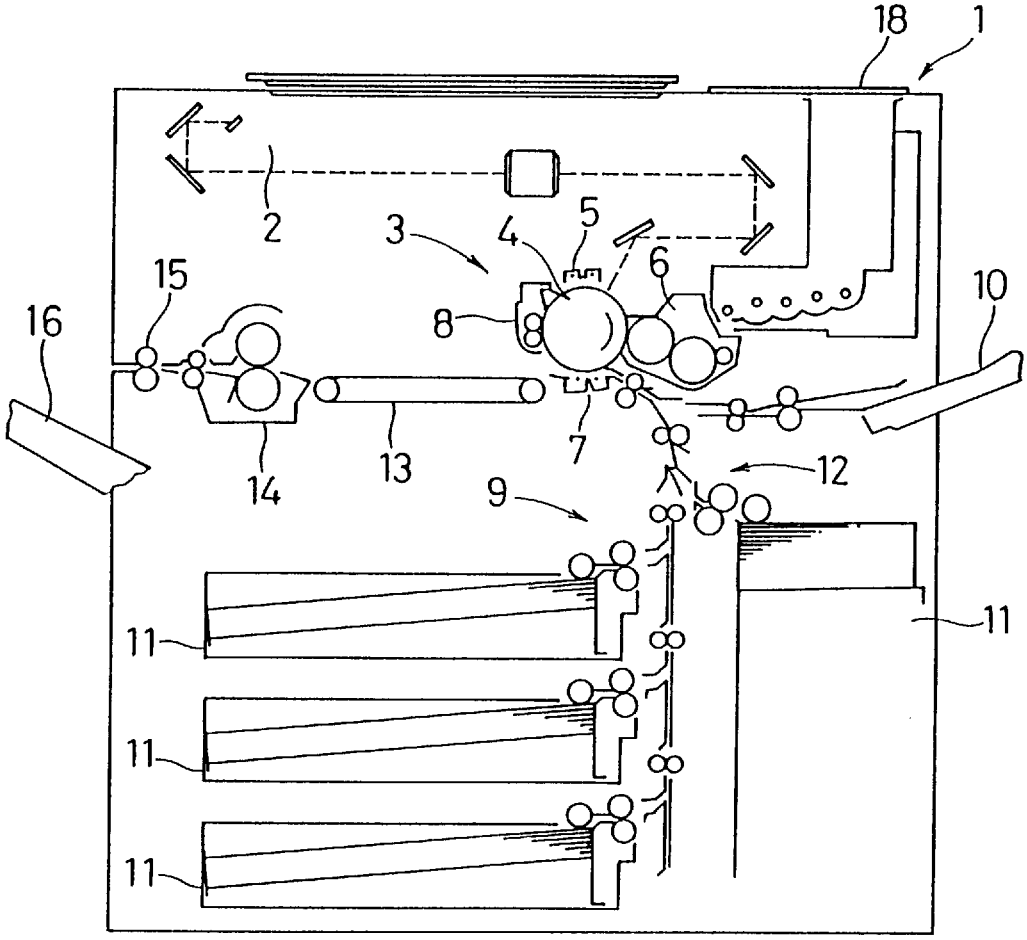
FIG. 2 is a cross-sectional view schematically showing a copier.

FIG. 2 shows the construction of the copier P. As shown in FIG. 2, the copier P is provided with an optical system 2 fitted in the upper part of the body 1. The optical system 2 is for reading an original and comprises a light source, mirrors, a lens unit, and other components. In the central part of the copier body 1 is provided an image forming section 3 for forming an image with toner based on the read original. The image forming section 3 has a photosensitive drum 4, on the surface of which an electrostatic latent image is formed. Arranged around the photosensitive drum 4 are a main charger 5, a developing unit 6, a transferring and separating charger 7, and a cleaning unit 8.

In the lower part of the copier body 1 is provided a paper feed section 9. The paper feed section 9 comprises a bypass table 10 that is disposed in the right-hand part of the copier body 1 shown in FIG. 2, a plurality of paper feed cassettes 11 arranged vertically in the lower part of the copier body 1, and a paper transfer unit 12 for transferring paper sheets stocked in the bypass table 10 or paper feed cassettes 11 to the image forming section 3. Arranged on the downstream side of the image forming section 3 along the paper transfer direction are a paper ejecting conveyor 13 for conveying paper sheets to the left-hand part of the copier shown in FIG. 2, a fixing unit 14 for fixing a toner image on paper by fusion, ejecting rollers 15 for ejecting paper sheets after image fixation, and a ejected-paper tray 16 for stocking ejected paper sheets.

Figure 3:
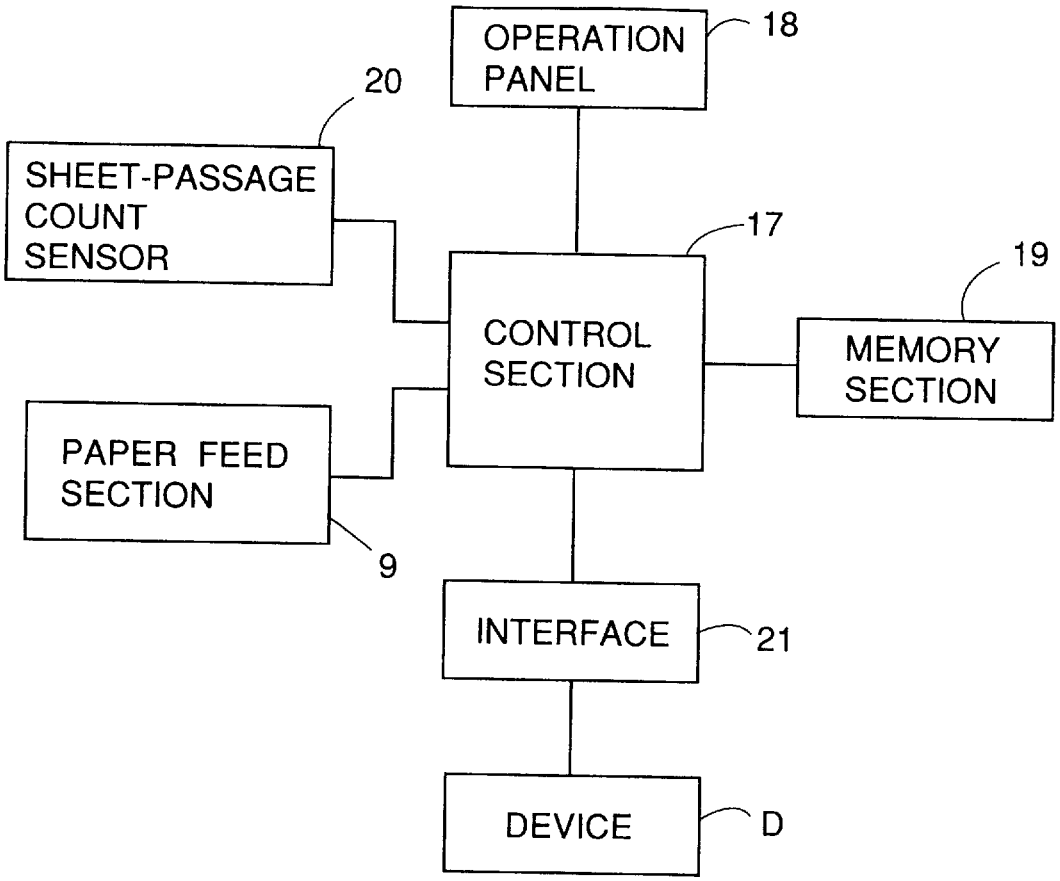
FIG. 3 is a block diagram showing the control system of the copier.

The copier body 1 is further equipped with a control section 17 shown in FIG. 3. The control section 17 is constructed as a microcomputer system including a CPU, a RAM, a ROM, a variety of drivers, and a variety of I/O ports, and an operation panel 18 is connected to it. As shown in FIG. 2, the operation panel 18 is disposed on the upper surface of the copier body 1, and includes an input keypad section and a display section composed of liquid crystal display devices, light emitting diodes, or other.

To the control section 17, a memory section 19 for storing a variety of operation data is connected. The memory section 19 stores, for example, the total count of copies produced by the copier body 1. Also connected to the control section 17 are a sheet-passage count sensor 20 for counting how many images have been formed, and a paper feed section 9 for feeding paper from paper feed cassettes 11. Actually, a plurality of sheet-passage count sensors 20 are arranged in appropriate positions along the paper feed path from each paper feed cassette 11 through the image forming section 3 and the fixing unit 14 to the ejected-paper tray 16, so that, when a correct passage of a paper sheet is detected, the total count stored in the memory section 19 is incremented. Furthermore, the control section 17 is connected through an interface 21 to the communications control device D, so that the copy count counted by the sheet-passage count sensor 20 is transmitted to that device D.

Figure 4:
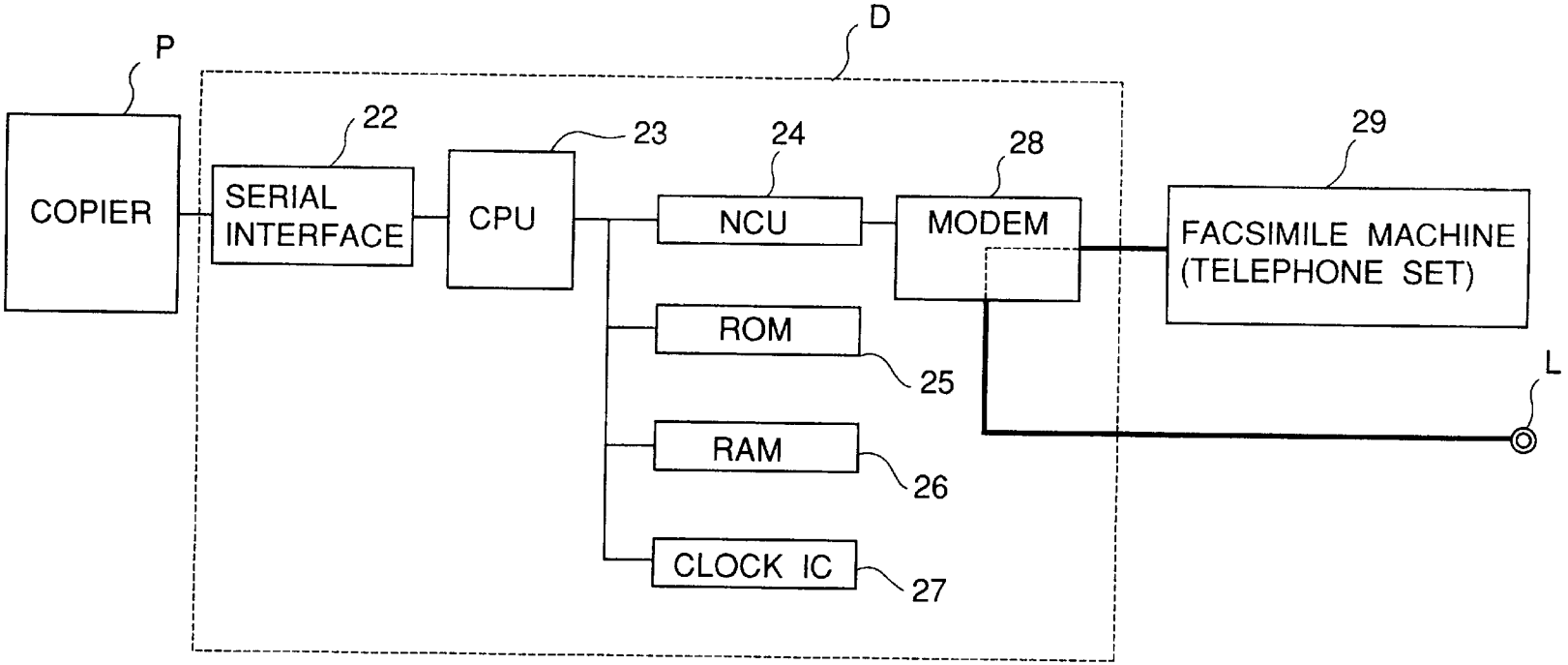
FIG. 4 is a block diagram showing the construction of the communications control device.

The communications control device D, which serves to transmit data required for managing the copier P to the host computer H, is, as shown in FIG. 4, equipped with a serial interface 22. The serial interface 22 is connected to a CPU 23. The CPU 23 is formed as a so-called microcomputer system, and is connected to an NCU (network control unit) 24, a ROM 25, a backup RAM 26, and a clock IC 27. The NCU 24 is connected to a modem 28, and the modem 28 is in turn connected to a public telephone line L.

Note, however, that it is not practical to use the telephone line L exclusively for the device D of the copier. In reality, as shown in FIG. 4, a telephone line for a facsimile machine (or telephone set) 29 is made to take a detour through the device D, and the device D is set for transmission only, so that, when a call is received through the telephone line, the device D does not answer the call but transfers it to the facsimile machine or telephone set. Accordingly, in the management system of this embodiment, the host computer H cannot originate a call to the devices D.

As shown in FIG. 5, in the RAM 26 of the device D are secured a plurality, e.g. 30 in this example, of count fields 30 serving as component lifetime management means, which manage counts for a plurality of individual components of the copier P. The count fields 30 can be individually reset by a signal from the copier P. The count fields 30 each have a field 30*a* in which a count to be interlocked with them is specified, so that the count fields are each incremented according to a particular signal thus specified and interlocked with them.

The count fields 30 can be freely allocated to individual components of the copier through operation from a keyboard of the host computer, and the counts to be interlocked with the individual count fields 30 can be freely specified. As a result, when a serviceperson, having checked the count fields 30, performs replacement of components whose count values have exceeded their threshold values and which therefore require replacement, it is possible to issue a component replacement report and transmit it to the host computer H.

As described above, since the count fields 30 in the device D can be freely allocated to a plurality of individual components of the copier P, and the counts to be interlocked with the individual count fields 30 can be freely specified, it is possible to perform lifetime management on a component-by-component basis, and thus to perform maintenance work without fail.

Figure 6:
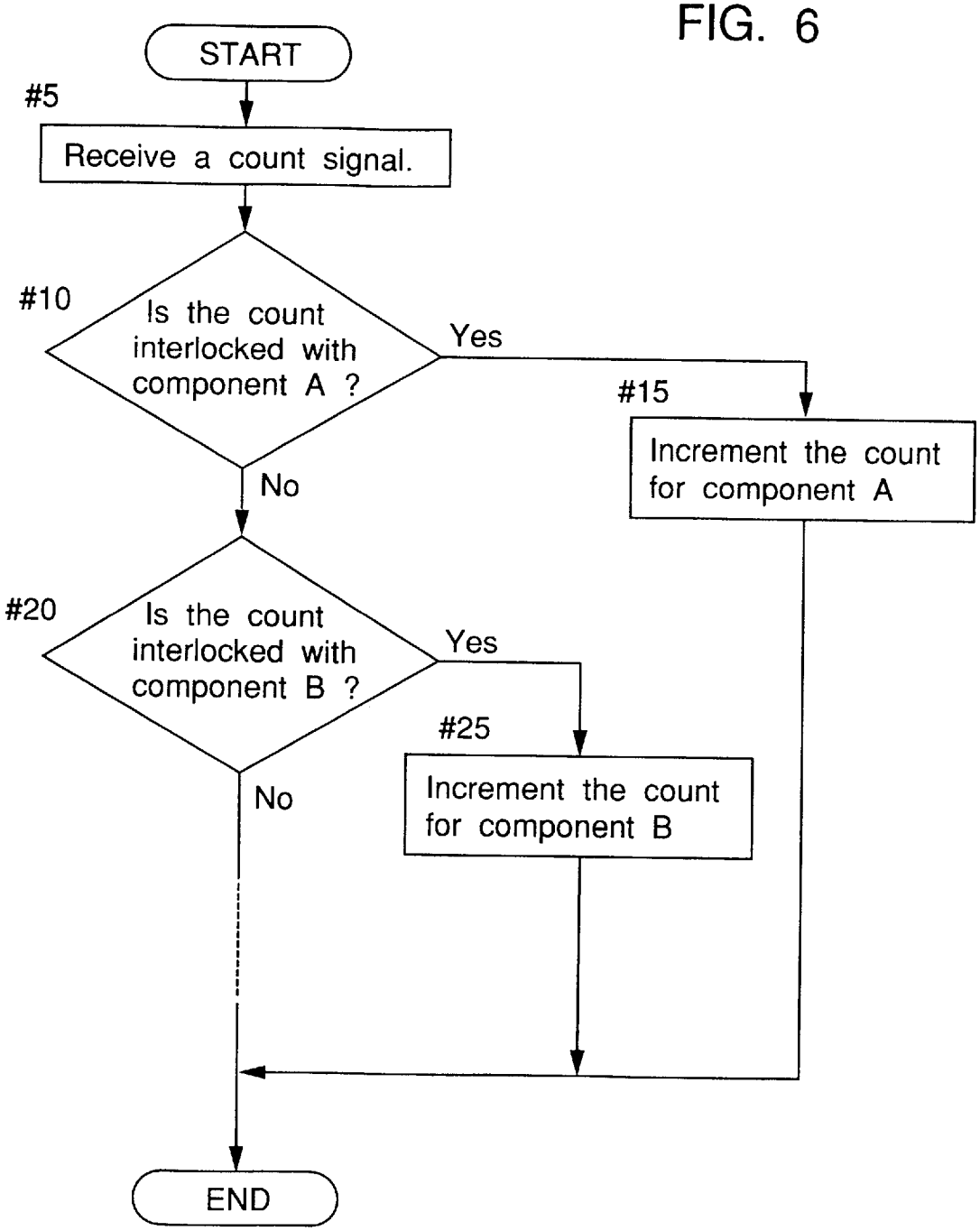
FIG. 6 is a flowchart showing the process of incrementing a count fields in the device.

FIG. 6 shows the process of incrementing the counts stored in the device D. As shown in FIG. 6, when, in step #5, the device D receives a count signal from the copier body 1, it checks the received signal against each of the count fields 30 successively in the order in which they are listed. For example, if, in step #10, the received signal is found to be a count interlocked with component A, then, in step #15, the count for component A is incremented. If the received signal is not a count interlocked with component A, the process proceeds to step #20, where the device D checks whether the received signal is a count interlocked with component B. If so, then, in step #25, the count for component B is incremented. Similarly, the checking is repeated with other components.

Figure 7:
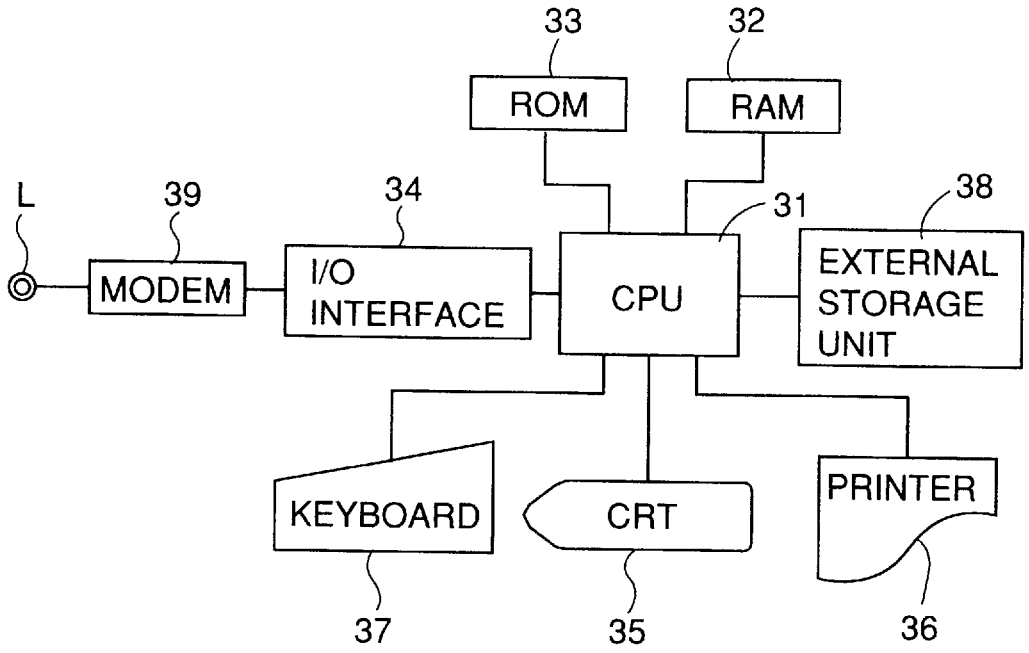
FIG. 7 is a block diagram showing the construction of the host computer.

The host computer H receives data originated from the device D, and, based on that data, manages the copiers P collectively. To achieve this, as shown in FIG. 7, the host computer H is provided with a CPU 31, a backup RAM 32, a ROM 33, and an input/output interface 34 connected to the CPU 31. Moreover, to the CPU 31, a CRT 35 for displaying data, a printer 36 for printing data, a keyboard 37 for entering data, an external storage unit 38 constituted of, for example, a hard disk, and others are connected. The input/output interface 34 is provided with an input/output terminals such as RS-232C, and is connected through a communications modem 39 to a public telephone line L.

The RAM 32 of the host computer H has in it a database for managing components requiring maintenance such as replacement. As shown in FIG. 8, the contents of the database can be displayed on the CRT 35 as a detailed maintenance data display screen 40. FIG. 8 shows a replacement component list, and accordingly all the entries listed there are marked as "replacement" in the work-type column. Actually, however, there are other work types such as "cleaning", "lubrication", "adjustment", and "checking", and the lists for these types are displayed on the CRT 35 at predetermined points of time.

In the column under the percent mark (%) are displayed values representing the degree to which each of the listed components has been used up to the moment. A value of 100% there indicates that the count value of the corresponding component has exceeded its threshold value. In the "remain" column are displayed values that specifically show how many counts remain up to the threshold value. In this way, once threshold values are registered in the host computer H, it is no longer necessary to use an extra amount of time for communication, as opposed to the conventional system in which threshold values are registered in the device D. Thus, it is possible to reduce communication costs.

The host computer H is provided with a capability of issuing a component urgency report list, which displays a listing of components targeted by component replacement warnings. The component urgency report list is processed as a part of a process called "component PM call" which is an internal process for originating a maintenance call on a component-by-component basis. In a similar way to the processing of urgency reports which is well-known in the art of copier management, the component PM call processes pop-up-screen displays on the CRT 35, displays of urgency report lists, automatic printout from the printer 36, and others.

However, differently from the well-known processing of urgency reports, here, the component PM call is not processed when a threshold value for one of individual components targeted by maintenance work has been exceeded. That is, the component PM call is not processed when a component has issued a component PM call and is shown as "yet to be processed" in an urgency report list. This prevents a component PM warning from being issued doubly for the same copier P.

Figure 9:
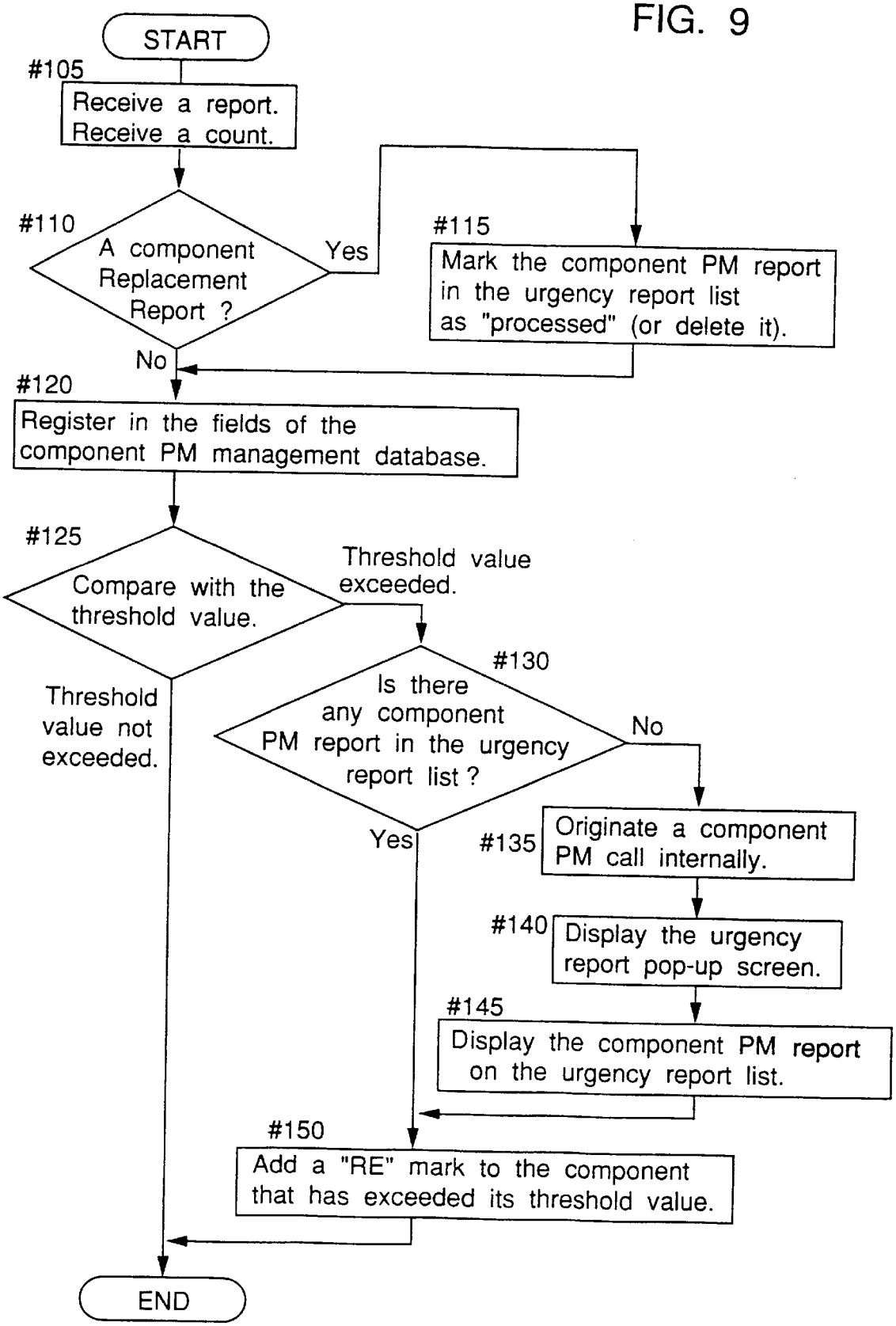
FIG. 9 is a flowchart showing the process performed in the host computer.

Next, the maintenance management operation of the host computer H will be described below with reference to the flowchart, FIG. 9. The count values in the device D are transmitted to the host computer H during communication between the two sides. Such communication takes place when, for example, the device D transmits a regular report. When, in step #105, the host computer H receives a component replacement report or a count value for a component, then, in step #110, the host computer H checks whether it is a component replacement report or a count value. If it is a component replacement report, the operation flow proceeds to step #115, where the corresponding entry in a component urgency report list is marked as "processed" in its component-replacement-report column, or that entry is deleted from the list.

In this way, when a component is replaced and a component replacement report informing of the component replacement is received from the device D, the corresponding entry in the component urgency report list can be automatically deleted. Accordingly, it is possible to prevent the same maintenance work from being performed doubly because of the failure of the host computer's operator to perform due processing. Moreover, even when a component has been replaced and the corresponding entry in the urgency report list has been deleted, if a threshold value of some other component has been exceeded and the corresponding component has not been replaced, a new warning is issued. Accordingly, it is possible to prevent failure to replace components.

If, in step #110, what has been received from the device D is a count value, the operation flow proceeds to step #120, where the count value is stored in the component maintenance management database, and simultaneously, in step #125, the count value is compared with the corresponding threshold value registered in the host computer H.

Then, if the threshold value is exceeded, the operation flow proceeds to step #130, where whether there exists a component PM report in the urgency report list or not is checked. If there is no component PM report, the operation flow proceeds to step #135, where a component PM call is internally originated, and then, in step #140, an urgency report pop-up screen as mentioned above is displayed to warn the operator. As described above, during this internal originating of a component PM call, when a threshold value of one of individual components that manage the component PM is exceeded, then, in step #145, the corresponding entry is shown as "yet to be processed" in the urgency report list, and, when some component has issued a component PM call, the component PM call is not processed.

As described above, issuance of a component replacement warning is disabled when, during a period after issuance of a component replacement warning for one component before replacement of the component targeted by that warning, another component becomes a target of a component replacement warning. As a result, since only one report is displayed until a component is replaced, it is possible to make the listing easy to follow, and thus to alleviate the workload for processing reports. Moreover, since the number of reports is minimized, it is possible to make the listing easy to understand, and thus to improve work efficiency.

A component PM call is not transmitted as a report unless it is processed and marked as "processed", but the data concerning components whose threshold values have been exceeded is displayed on the detailed maintenance data display screen shown in FIG. 8. In step #150, to the entries corresponding to components whose count values have exceeded their component PMs, a mark "RE", which represents "to be replaced", is added in their "RE" column. In this way, components that are being used beyond their lifetimes are displayed with a mark in a listing. Accordingly, it is possible to procure components beforehand without fail.

Figure 10:
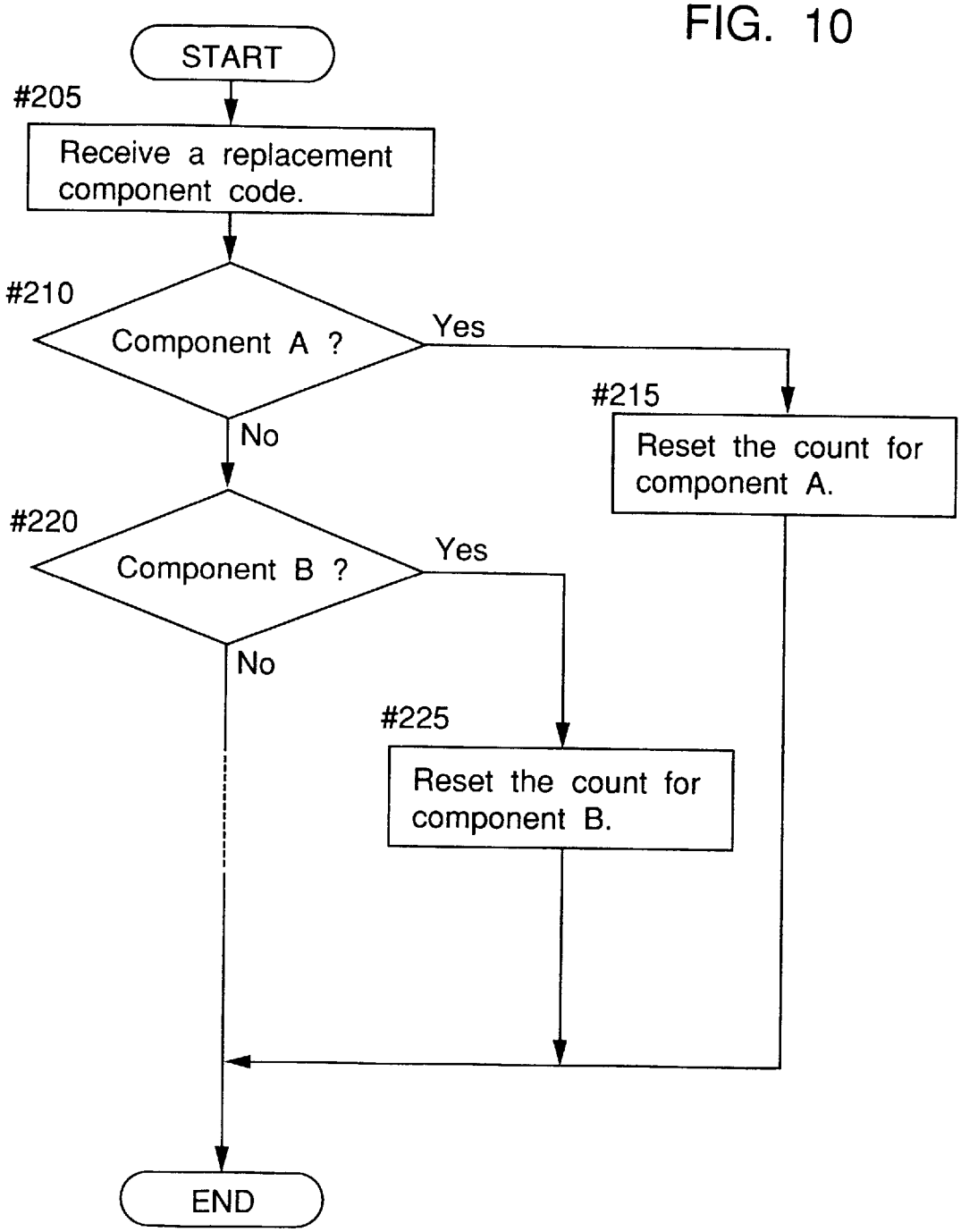
FIG. 10 is a flowchart showing the process of clearing the counts in the device.

On the other hand, the communications control device D, while it is communicating with the host computer H, clears the counts for the components about which it has received warnings from the host computer H, according to the process shown in FIG. 10. Specifically, when, in step #205, the device D receives a replacement component code from the copier P, it checks the received code against the count fields 30 successively in the order in which they are listed. For example, if, in step #210, the received replacement component code is found to correspond to component A, then, in step #215, the count for component A is reset. If the received replacement component code does not correspond to component A, the process proceeds to step #220, where the device D checks whether the code corresponds to component B or not. If so, in step #225, the count for component B is reset. Similarly, the checking is repeated with other components.

In the above described process, whether a component PM is issued or not is determined based on calculation performed during communication between the device D and the host computer H, for example, during a regular communication session. In this case, however, it may happen that, if there is no communication for a long time, the host computer H cannot recognize that a component PM has been exceeded.

To cope with such a situation, in this embodiment, the host computer H calculates rates of incrementing based on, for example, average counts per day, so that component PM calls can be issued based on expected values even when there is no communication. In this case, it is convenient to set threshold values at which component PM calls are issued based on expected values to such values that are slightly greater than actual threshold values obtained by communication. The reasons are as follows.

When there is communication from the device after a component PM call has been issued based on an expected value, it sometimes happens that the actual value has not reached the component PM value (threshold value) yet. In such a case, it is necessary to delete the component PM call issued based on the expected value. This causes confusion. A component PM is only a guidepost for component replacement, and therefore it does not indicate that a component does not work properly unless it is replaced as soon as its component PM is exceeded. Accordingly, a component PM, especially when it is based on an expected value, can be set to include a small allowance without any undesirable consequences.

As described above, if the host computer H is so configured that it can execute usual processing based on expected lifetimes of components even when it cannot receive count values for the components through communication with the device D, it is possible to issue warnings based on expected values when there is no communication. As a result, it is possible to operate the system even in the cases where communication intervals are long.

Note that the present invention can be applied not only to management systems for copiers, but also to management systems for other types of image forming equipment such as laser printers, facsimile machines, etc.

As described above, according to the present invention, the communications control device is provided with a plurality of count fields which can be freely allocated to a plurality of individual components of a piece of equipment to be managed and which can be reset by a signal from the piece of equipment to be managed. In addition, the counts to be interlocked with the individual count fields can be freely specified. Accordingly, it is possible to perform lifetime management on a component-by-component basis, and thus to perform maintenance work without fail.

The host computer compares the counts for individual components as received from the communications control device with their respective threshold values, and, when there exists a component whose threshold value has been exceeded, recognizes necessity of component replacement and warn the communications control device of the necessity of component replacement. Accordingly, as against the conventional system where threshold values are registered in the device, it is possible to dispense with an extra amount time for communication, and thus to effectively reduce communication costs.

Issuance of a component replacement warning is disabled when, during a period after issuance of a component replacement warning for one component and before replacement of the component targeted by that warning, some other component becomes a target of a component replacement warning. Accordingly, since only one report is displayed until a component is replaced, it is possible to make the listing easy to follow within the same piece of equipment to be managed, and thus to alleviate the workload for processing reports. Moreover, since the number of reports is minimized, it is possible to make the listing easy to grasp, and thus to greatly improve work efficiency.

When a component replacement report is received from the communications control device, a process for indicating that the corresponding component has already been replaced is executed automatically from a component urgency report list, so that, when the component is replaced, the entry corresponding to that component in the urgency report list can be deleted automatically. Accordingly, it is possible to prevent the same maintenance work to be performed doubly because of the failure of the host computer to perform due processing. Moreover, even under the condition that a component has been replaced and the entry corresponding that component in the urgency report list has been deleted, when some other component has exceeded its threshold value for component replacement and has not been replaced yet, a new warning can be issued. Accordingly, it is possible to prevent failure to replace components.

The host computer is provided with a capability of adding a mark requesting replacement to those entries listed on a management list which correspond to component targeted by component replacement warnings, so that components that are being used beyond their lifetimes are displayed with a mark in the list. Accordingly, it is possible to procure components beforehand without fail.

When the host computer cannot receive count values of individual components through communication with the device, it executes usual processing based on expected lifetimes of the components, so that, when there is no communication, warnings are issued based on the expected lifetimes. Accordingly, it is possible to operate the system without any inconvenience even in the cases where communication intervals are long.

What is claimed is:

1. An equipment management system comprising a communications control device that is attached to a managed piece of equipment so as to transmit equipment management data with which the piece of equipment is managed, and a host computer that is connected to said communications control device through a communications network so as to collectively manage data received from the communications control device, wherein said communications control device is provided with a component lifetime management means having a plurality of count fields allocated to a plurality of components of said managed piece of equipment said component lifetime management means storing count values representing how many times the components have been involved in processing in the count fields, respectively, and clearing the count value in a count field when the component to which the count field is allocated is replaced, said component lifetime management means further having transmitting means for transmitting the count values in the count fields to said host computer at predetermined times, and wherein said host computer is provided with a warning means which, for every component, compares a count value received from said communications control device with a threshold value and which, when there exists a component whose threshold value is exceeded recognizes necessity of component replacement and issues a component replacement warning, and said host commuter is further provided with a warning disabling means which disables issuance of a component replacement warning if, during a period after issuance of a component replacement warning for one component and before replacement of the component targeted by the warning, another component becomes a target of a component replacement warning.

2. An equipment management system as claimed in claim 1, wherein said communications control device sends a component replacement report to said host computer when a component requiring replacement is replaced, and said warning means of the host computer issues a component urgency report list for displaying a listing of components targeted by component replacement warnings and automatically executes a process for indicating in the component urgency resort list that a component has already been replaced when a component replacement report is received from said communications control device.

3. An equipment management system as claimed in claim 1, wherein said host computer adds a mark requesting replacement to entries listed on a management list that correspond to components targeted by component replacement warnings.

4. An equipment management system as claimed in claim 1, wherein said host computer continues usual processing based on expected lifetimes of components when count values stored in the component lifetime management means cannot be received through communication with the communications control device.

5. An equipment management system as claimed in claim 1, wherein said communications control device is attached to an electronic photocopier so as to transmit data concerning use of the copier to the host copier.

6. An equipment management system as claimed in claim 1, wherein allocation of the count fields of the component lifetime management means to components is changeable in accordance with a managed piece of equipment to which the communications control device is attached, and interlocking of the count fields to a processing of the managed piece of equipment is changeable.

7. An equipment management system comprising:

a communications control device for transmitting equipment management data corresponding to a managed piece of equipment; and a host computer for collectively managing data received from the communications control device, said host computer communicating with said communications control device via a communications network, wherein said communications control device includes component lifetime managing means for storing count values in a count field representing the number of times a component of said managed piece of equipment has been involved in processing, and transmitting means for transmitting count values stored in said count field to said host computer via said communications network at predetermined times, said host computer includes warning means for issuing a component replacement warning, said warning means comparing a transmitted count value received from said communications control device with a threshold value stored by said host computer and issuing a component replacement warning when said transmitted count value exceeds said threshold value, and said host computer further includes warning disabling means for disabling issuance of a component replacement warning if, during a period after issuance of a component replacement warning for one component and before equipment of said one component, another component becomes a target of a component replacement warning.

8. The equipment management system defined by claim 7, wherein:

said host computer further includes means for generating an urgency report listing components targeted by component replacement warnings.

9. The equipment management system as claimed in claim 8, wherein:

said communications control device further includes means for generating a component replacement report when a component targeted by a component replacement warning is replaced, and said host computer further includes means for automatically removing a component replacement warning from said urgency report when said host computer receives a corresponding component replacement report from said communication control device.

10. The equipment management system as claimed in claim 9, wherein:

said host computer further includes means for generating a management list and means for indicating components on said management list that are targeted by a component replacement warning with an indication thereof.

11. The equipment management system as claimed in claim 10, wherein:

said host computer further includes means for generating warning replacement warnings based on expected lifetimes of components when count values are not received from said communications control device.

12. The equipment management system as claimed in claim 11, wherein:

said predetermined times are separated by time intervals of predetermined length.

13. The equipment management system as claimed in claim 12, wherein:

at least two time intervals have essentially equal lengths.

14. The equipment management system as claimed in claim 13, wherein:

said managed piece of equipment is a photocopying machine.

15. An equipment managing method for managing a piece of equipment with a communications control device and a host computer communicating with said communications control device via a communications network, said method comprising:

incrementing a count value stored in a count field of said communications control device corresponding to a component of said piece of equipment when a process interlocked with said component occurs;

transmitting said count value to said host computer in accordance with predetermined times;

comparing said count value received by said host computer with a threshold value stored in said host computer; and issuing a component replacement warning when said count value received by said host computer exceeds said threshold value, and disabling said warning if, during a period after issuance of a component replacement warning for said component and before replacement of said component, another component becomes a target of a component replacement warning.

* * * * *